US012318052B2

(12) United States Patent
Jeong et al.

(10) Patent No.: US 12,318,052 B2
(45) Date of Patent: Jun. 3, 2025

(54) CONTROL METHOD OF DISHWASHER

(71) Applicant: LG ELECTRONICS INC., Seoul (KR)

(72) Inventors: Min Jae Jeong, Seoul (KR); Hyung Man Park, Seoul (KR); Deok Won Kang, Seoul (KR); Jeongkon Kim, Seoul (KR); Jeong In Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 171 days.

(21) Appl. No.: 18/079,286

(22) Filed: Dec. 12, 2022

(65) Prior Publication Data

US 2023/0210338 A1 Jul. 6, 2023

(30) Foreign Application Priority Data

Dec. 31, 2021 (KR) ..... 10-2021-0194347

(51) Int. Cl.
*A47L 15/00* (2006.01)
*A47L 15/48* (2006.01)

(52) U.S. Cl.
CPC ..... *A47L 15/0034* (2013.01); *A47L 15/486* (2013.01); *A47L 15/488* (2013.01); *A47L 2501/10* (2013.01); *A47L 2501/11* (2013.01); *A47L 2501/12* (2013.01); *A47L 2501/30* (2013.01)

(58) Field of Classification Search
CPC ... A47L 15/0034; A47L 15/486; A47L 15/488
See application file for complete search history.

(56) References Cited

FOREIGN PATENT DOCUMENTS

DE 102018128709 A1 * 5/2020
KR 20070120254 12/2007

OTHER PUBLICATIONS

Machine translation: KR1020070120254; Yoon et al. (Year: 2007).*
Machine translation: DE102018128709; Ronning et al. (Year: 2020).*

* cited by examiner

*Primary Examiner* — Natasha N Campbell
(74) *Attorney, Agent, or Firm* — Fish & Richardson P.C.

(57) ABSTRACT

A method controls a dishwasher including a tub configured to receive objects to be washed, a drying device configured to receive wet air from the tub and to discharge the wet air to an outside of the dishwasher, and a dry air supplier including a heating part and being configured to supply heated air to the tub. The method includes preheating the drying device by introducing dry air from the outside to the drying device before a first preset time from a start point of a drying operation, performing the drying operation at the start point, wherein the wet air is discharged from the tub during the drying operation, and cooling the dry air supplier by stopping operation of the heating part before a second preset time from an end time point of the drying operation.

20 Claims, 10 Drawing Sheets

CONTROL METHOD OF DISHWASHER

CROSS-REFERENCE TO RELATED APPLICATION

This application claims priority to and benefit of Korean Patent Application No. 10-2021-0194347, filed on Dec. 31, 2021, which is hereby incorporated by reference as if fully set forth herein.

TECHNICAL FIELD

The present disclosure relates to a control method of a dishwasher, more particularly, a control method of a dishwasher including a drying device and a dry air supplier.

BACKGROUND

A dishwasher is an electric appliance configured to wash dishes provided as washing targets by, for example, spraying wash water. In some examples, wash water used for dishwashing may include a dishwashing detergent.

By using the dishwasher, the time and effort for washing dishes after eating may be reduced, thereby contributing to user's convenience.

In some cases, in order to quickly dry washing targets that are washed in a dishwashing process using wash water, the dishwasher may include a structure configured to spray air to the washing targets. For example, the air sprayed to the washing targets may be heated and sprayed to the tub. Accordingly, a dry air supplier may be provided in the dishwasher to supply heated air, that is, a dry air to the tub.

In some cases, the dry air supplier may include a heating part mounted therein. The heating part could become high-temperature in a process of making dry air. Accordingly, the entire dry air supplier might become high temperature. At least some area of the dry air supplier could be exposed to the tub. In some cases, a user might inadvertently come into contact with the dry air supplier, which might result in injury to the user.

In addition, the dishwasher may be provided with a drying device for quick drying of dishes. The drying device may be configured to operate after a heating and rinsing process configured to rinse the dishes stored in the tub by heating wash water in a washing process.

For instance, the drying device may discharge steam from the inside to the outside of the tub and vaporize the wash water remaining on surfaces of the dishes stored in the tub, only to dry the dishes. The wet air flowing in from the tub to the drying device may be relatively high temperature and the dry air flowing in the drying device from the outside may be relatively low temperature.

In some cases, when the high temperature wet air and the low temperature dry air are mixed, condensation could occur in the wash water existing in a vapor state in the high-temperature wet air to make a condensate that is condensed water. The condensate may be condensed on an inner wall of the drying device and fall by gravity.

In some cases, the condensed water falling by gravity could accumulate on the floor of the location where the dishwasher is installed through an air outlet of the mixed air. The accumulated condensate might cause inconvenience in that the user has to manually remove and wipe it out. For example, the drying device may include a duct configured to discharge the mixed air generated in the drying device outside. The condensate generated from the mixed air could be condensed on an inner wall of the duct and fall by gravity so that it might leak to the floor of the location where the dishwasher is installed through the air outlet of the duct.

SUMMARY

The present disclosure describes a control method of a dishwasher including a dry air supplier and a drying device, with a structure configured to dry dishes in the dishwasher efficiently and safely.

The present disclosure further describes a control method of a dishwasher, with a structure configured to efficiently suppress injuries such as burns to a user due to a dry air supplier heated at a high temperature.

The present disclosure also describes a control method of a dishwasher with a structure configured to suppress generation of dew condensation.

In some implementations, a drying device is controlled in consideration of the fact that a second inlet is gradually closed or opened, since an actuator is mechanically operated by a motor, once a controller instructs the actuator to close or open the second inlet.

According to one aspect of the subject matter described in this application, a method controls a dishwasher including a tub configured to receive objects to be washed, a drying device configured to receive wet air from the tub and to discharge the wet air to an outside of the dishwasher, and a dry air supplier including a heating part and being configured to supply heated air to the tub. The method includes preheating the drying device by introducing dry air (ambient air) from the outside to the drying device before a first preset time from a start point of a drying operation, performing the drying operation at the start point, wherein the wet air is discharged from the tub during the drying operation, and cooling the dry air supplier by stopping operation of the heating part before a second preset time from an end time point of the drying operation.

Implementations according to this aspect can include one or more of the following features. For example, the drying device includes a casing that defines (i) a first air inlet configured to receive the dry air from the outside and (ii) a second air inlet configured to receive the wet air from the tub, an actuator coupled to the casing and configured to open and close the second air inlet, a first ventilation fan coupled to the casing and configured to cause the dry air and the wet air to be mixed and discharged from the first ventilation fan, and a duct that is in fluid communication with the casing and configured to discharge the mixed air from the first ventilation fan to the outside. Preheating the drying device can include operating the first ventilation fan.

In some implementations, the dry air supplier includes a housing that defines an air flow path configured to guide air discharged from the tub, a second ventilation fan coupled to the housing and configured to cause flow of the air in the air flow path, where a least a portion of the heating part is disposed inside the housing to thereby heat the air blown by the second ventilation fan, an air discharge part that is coupled to the housing and configured to guide the air from the air flow path of the housing to the tub, and a discharge cap coupled to an end of the air discharge part and exposed to the tub, the discharge cap configured to discharge the air from the discharge part to the tub. In some examples, the drying operation can include operating the drying device and the dry air supplier together.

In some implementations, the drying operation further can include heating air blown into the dry air supplier such that the air is heated through the heating part, passes through the discharge cap, and then is discharged into the tub, heating wet air in the tub by the heated air discharged into the tub, and discharging the heated wet air from the tub into the drying device such that the heated wet air and the dry air from the outside are mixed in the duct and discharged through the duct. In some examples, the drying operation further can include controlling a flow rate of the wet air discharged from the tub to the drying device to be greater than or equal to a flow rate of the air introduced into the tub from the dry air supplier.

In some implementations, the discharge cap can be disposed at a corner of a lower area of the tub adjacent to a first wall of the tub, and the actuator can be disposed at an upper area of a second wall facing the first wall of the tub. In some implementations, the method can further include washing the objects in the tub and heating and rinsing the objects by wash water, where preheating the drying device can include preheating the duct of the drying device by operating the first ventilation fan after heating and rinsing the objects. The drying operation can be performed for drying water remaining on the objects, where cooling the dry air supplier can include cooling the discharge cap by stopping operation of the heating part. In some examples, preheating the duct can include, while the duct is preheated, controlling the actuator to close the second air inlet and stopping operation of the second ventilation fan and the heating part. In some examples, the drying operation can include, while water remaining on the objects is dried, controlling the actuator to open the second air inlet and operating the second ventilation fan and the heating part.

In some implementations, cooling the discharge cap can include, while the discharge cap is cooled, stopping operation of the heating part, operating the second ventilation fan and the heating part, and controlling the actuator to switch the second air inlet from an open state to a closed state. In some examples, controlling the actuator can include controlling the actuator to complete closing of the second air inlet before a preset time period from an end time point of cooling the discharge cap. In some implementations, the discharge cap and the second air inlet can be disposed on a diagonal line across the tub in a cross sectional view of the tub. In some implementations, the first preset time can be equal to the second preset time.

According to another aspect, a method controls a dishwasher including a tub configured to receive objects to be washed, a drying device including a duct and a first ventilation fan, and a dry air supplier including a heating part and a discharge cap. The method includes washing the objects in the tub, heating and rinsing the objects by wash water, preheating the duct by operating the first ventilation fan, performing a drying operation for drying water remaining on the objects, and cooling the discharge cap by stopping operation of the heating part. Preheating the duct can include blowing dry air from an outside of the dishwasher to the duct before a first preset time from a start point of the drying operation, where wet air is discharged from the tub during the drying operation.

Implementations according to this aspect can include one or more of the following features. For example, cooling the discharge cap can include stopping operation of the heating part before a second preset time from an end time point of the drying operation. In some examples, preheating the duct can include blocking inflow of the wet air from the tub to the duct while the duct is preheated by dry air that is present near the dishwasher and heated while heating and rinsing the objects. In some implementations, the first preset time can be equal to the second preset time.

In some implementations, the drying device can further include a casing that defines (i) a first air inlet configured to receive the dry air from the outside and (ii) a second air inlet configured to receive the wet air from the tub, and an actuator coupled to the casing and configured to open and close the second air inlet. The first ventilation fan can be coupled to the casing and configured to cause the dry air and the wet air to be mixed and discharged from the first ventilation fan. The dry air supplier can further include a housing that defines an air flow path configured to guide air discharged from the tub, and a second ventilation fan coupled to the housing and configured to cause flow of the air in the air flow path, where a least a portion of the heating part is disposed inside the housing to thereby heat the air blown by the second ventilation fan. Preheating the duct can include controlling the actuator to close the second air inlet and operating the first ventilation fan while operations of the second ventilation fan and the heating part are stopped.

In some implementations, the heating part can include a heating coil electrically connected to a power source, where performing the drying operation can include supplying electric current to the heating coil while operating the actuator, the first ventilation fan, and the second ventilation fan.

In some implementations, the drying device and the dry air supplier can be used together in the drying operation. Accordingly, the dry air supplier can quickly evaporate water remaining on the dishes and the drying device can quickly discharge wet air inside the tub to the outside the dishwasher. Accordingly, the time taken to dry the dishes can be remarkably reduced.

In some implementations, the tub can maintain a zero pressure or negative pressure during the drying operation, thereby smoothly facilitating dry air flow into the tub from the dry air supplier. In addition, the tub can maintain the zero pressure or the negative pressure during the drying operation, thereby suppressing the wet air inside the tub from leaking through a gap of the tub during the drying operation, not through the outlet of the duct.

Accordingly, dew condensation that might occur on an outer surface of the dishwasher due to the wet air leaking through the gap of the tub can be effectively suppressed. The user's injury caused by the wet air can be effectively suppressed.

In some implementations, a line connecting the discharge cap and the second air inlet can form a diagonal line of the tub, viewed from a cross section of the tub. Accordingly, the outlet of the discharge cap and the second air inlet can be spaced apart from each other and the dry air discharged from the discharge cap can be sufficiently dispersed inside the tub, not to flow into the second air inlet immediately, thereby effectively evaporating water remaining on the dishes.

The control method of the dishwasher can further include a preheating operation configured to preheat the drying device before the drying operation. When the dry air heated in the preheating operation flows inside the drying device, the duct provided in the drying device can be preheated. When the duct is heated, the mixed air flowing inside the duct during the drying operation can be sufficiently heated. Accordingly, a temperature difference between the duct and the mixed air can be reduced.

Therefore, dew condensation occurring on an inner wall of the duct due to a large temperature difference between the duct and the mixed air can be effectively suppressed.

The control method of the dishwasher can include a cooling operation for cooling the dry air supplier before the drying operation ends. The outside air in a not-heated state can flow inside the dry air supplier during the cooling operation, thereby cooling the heating part and the discharge cap by using the flowing outside air. After the discharge cap is sufficiently cooled, the cooling operation can end and the entire washing process can end together with the end of the cooling operation.

Even if the user opens the door and touches the discharge cap exposed to the tub after the washing process ends, the discharge cap can be already in a state of being sufficiently cooled enough not to cause a burn to the user. Accordingly, the user's burn can be effectively suppressed.

Specific effects are described along with the above-described effects in the section of detailed description.

DETAILED DESCRIPTION

Figure 1:
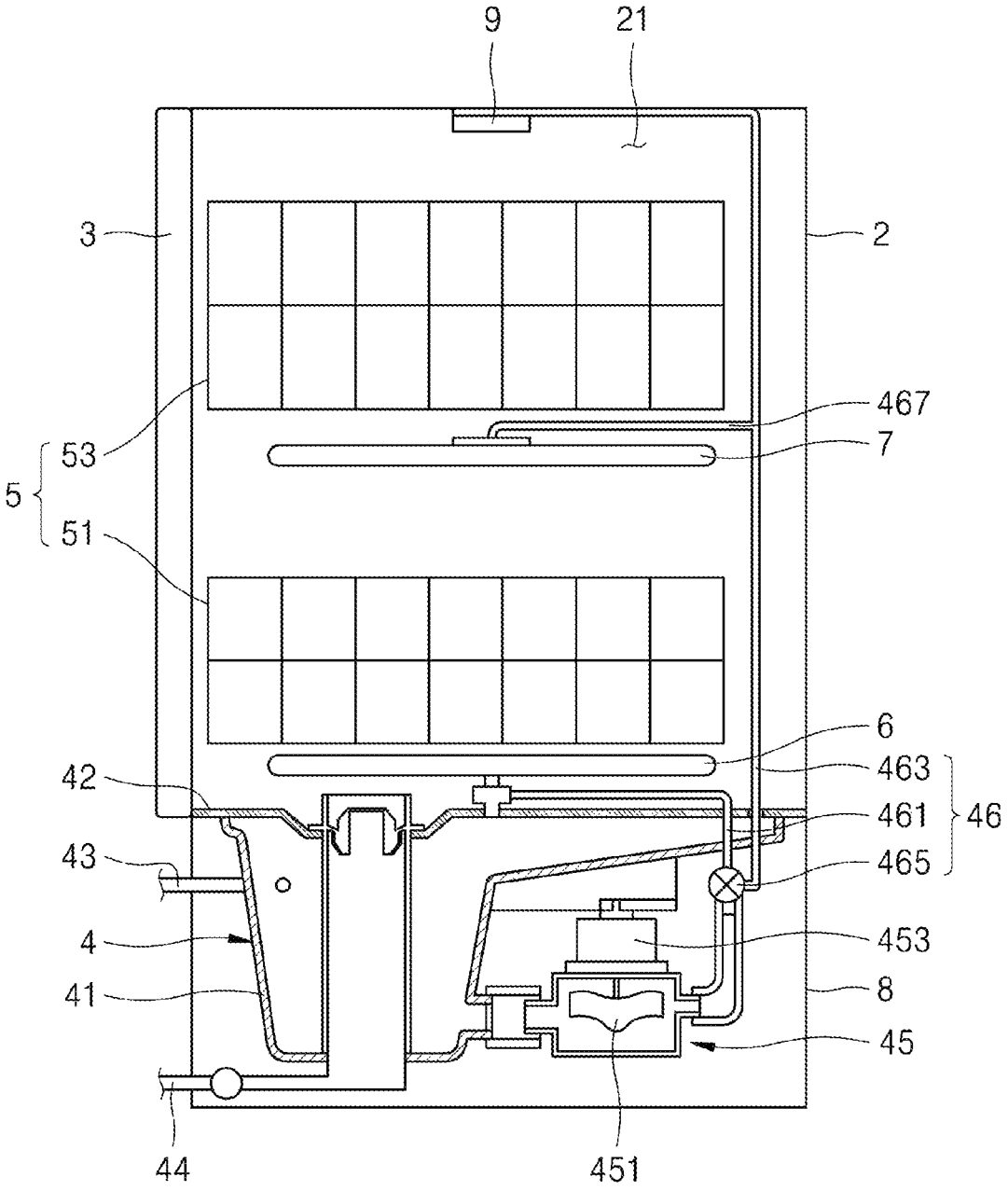
FIG. 1 is a sectional view schematically showing an example of a dishwasher.

The above-described aspects, features and advantages are specifically described hereunder with reference to the accompanying drawings such that one having ordinary skill in the art to which the present disclosure pertains can easily implement the technical spirit of the disclosure. In the drawings, identical reference numerals can denote identical or similar components.

Throughout the present disclosure, "up-down direction (or a vertical direction)" refers to an up-and-down direction of a dishwasher. "Left-right direction (or horizontal direction)" refers to a direction orthogonal to the up-down direction, and "front-back direction refers to a direction orthogonal to both the up-down direction and the left-right direction. "Both side directions" or "lateral directions" have the same meaning as the left-right direction. These terms can be used interchangeably herein.

FIG. 1 is a sectional view schematically showing an example of a dishwasher.

For example, referring to FIG. 1, the dishwasher can include a housing defining an exterior of the dishwasher, a tub 2 defining a washing space 21 defined inside the housing and configured to receive dishes as washing targets, a door 3 rotatably coupled to a base 8 and configured to selectively open and close the washing space 21, a sump 4 provided in a lower area of the tub 2 and configured to store wash water, a storage part 5 provided inside the tub 2 and configured to store the washing targets, and spray arms 6, 7, and 9 configured to spray wash water toward the washing targets stored in the storage part 5. For instance, the dishes can include bowls, plates, spoons, chopsticks, or other cooking utensils.

The tub 2 can define the washing space 21 and receive dishes. The storage part 5 and the spray arm 6, 7, and 9 can be provided inside the washing space 21. The tub has one open surface and the open surface can be closable by the door 3.

The door 3 can be rotatably coupled to the housing and configured to selectively open and close the washing space. For example, a lower portion of the door 3 can be coupled to the housing by a hinge. For example, the door 3 can be rotatably on the hinge to open and close the tub 2. When the door 3 is opened, the storage part 5 can be drawn to the outside of the dishwasher and the drawn storage part 5 can be supported by the door 3.

The sump 4 can include a storage portion 41 configured to store wash water, a sump cover 42 configured to partition off the storage portion 41 from the tub 2, a water supply portion 43 configured to supply wash water to the storage portion 41 from the outside, a water discharge portion 44 configured to discharge the wash water from the storage portion 41, and a water supply pump 45 and a water supply path 46 that are configured to supply the wash water stored in the storage portion 41 to the spray arms 6, 7, and 9.

The sump cover 42 can be disposed on a top of the sump 4 and configured to separate the sump 4 from the tub 2. In addition, the sump cover 42 can include a plurality of water collection holes configured to recollect the wash water sprayed to the washing space 21 through the spray arms 6, 7, and 9.

Specifically, the wash water sprayed from the spray arms 6, 7, and 9 can fall down to the bottom of the washing space 21 and pass through the sump cover 42 to be recollected in the storage portion 41 of the sump 4.

The water supply pump 45 can be provided in a side area or a lower area of the storage portion 41 and configured to supply wash water to the spray arms 6, 7, and 9. In some examples, the water supply pump 45 can have one end connected to the storage portion 41 and the other end connected to the water supply path 46. An impeller 451 and a motor 453 can be provided inside the water supply pump 45. When electricity is supplied to the motor 453, the impeller 451 can be rotated and the wash water of the storage portion 41 can be supplied to the spray arms 6, 7, and 9 through the water supply path 46.

The water supply path 46 can be configured to selectively supply the wash water flowing in from the water supply pump 45 to the spray arms 6, 7, and 9. For example, the water supply path 46 can include a first water supply path 461 connected to a lower spray arm 6, a second water supply path 463 connected to an upper spray arm 7 and a top nozzle 9, and a water supply path switching valve 465 configured to selectively open and close the water supply paths 461 and 467. In some examples, the water supply path switching valve 465 can be controlled to sequentially or simultaneously open the water supply paths 461 and 463.

In some implementations, at least one storage part 5 can be provided in the washing space 21 to store dishes. Two storage parts 5 are provided in the dishwasher shown in FIG. 1, but the present disclosure is not limited thereto.

As one example, the dishwasher can include only one storage part or three or more storage parts. In some examples, the number of the spray arms can be variable based on the number of the storage parts.

The storage part 5 can include a lower rack 51 and an upper rack 52 to store dishes. The lower rack 51 can be disposed in the washing space 21 and dishes can be stored in the lower rack 51. The upper rack 53 can be disposed above the lower rack 51 and dishes can be stored in the upper rack 53. Here, a top rack can be disposed between a space between a top of the upper rack 53 and a top nozzle 9, and dishes can be stored in the top rack.

The lower rack 51 can be disposed above the sump 4 and the upper rack 53 can be positioned higher than the lower rack 51. The lower rack 51, the upper rack 52 and the top rack can be movable to the outside through the open surface of the tub 2.

For example, a rail type holder can be provided on an inner surface of the tub 2. Wheels can be provided on a lower surface of the rack 51 and 53. The user can store dishes or take out the washed dishes by withdrawing the storage part 5 to the outside.

The spray arm can be provided inside the tub 2 and configured to spray wash water toward the dishes stored in the storage part 5. The spray arm can include a lower spray arm 6, an upper spray arm 7 and a top nozzle 9.

The lower spray arm 6 can be rotatably provided below the lower rack 51 and configured to spray to the dishes. The upper spray arm 7 can be rotatably provided between the upper spray arm 7 and the lower rack 51 and configured to spray wash water to the dishes.

The lower spray arm 6 can be rotatably coupled to a top of the sump cover 42 and configured to spray wash water toward the dishes stored in the lower rack 51. The upper spray arm 7 can be disposed above the lower spray arm 6 and configured to spray wash water toward the dishes stored in the upper rack 53. The top nozzle 9 can be provided in an upper are of the washing space 21 and configured to spray wash water to the lower rack 51 and the upper rack 53.

As described above, the first water supply path 461 can be configured to supply wash water to the lower spray arm 6 and the second water supply path 463 can be configured to supply wash water to the upper spray arm 7 and the top nozzle 9.

Referring to FIG. 1, the dishwasher can include a base 8. The base 8 can be disposed underneath the tub 2 and the tub 2 can be secured to the base. The base 8 can provide a space in which the sump 4 is disposed, and also a space in which the pump, the dry air supplier 200 and other various mechanisms are disposed.

Accordingly, the base 8 can have an outer wall to support the entire dishwasher and form a space to accommodate various devices.

Figure 2:
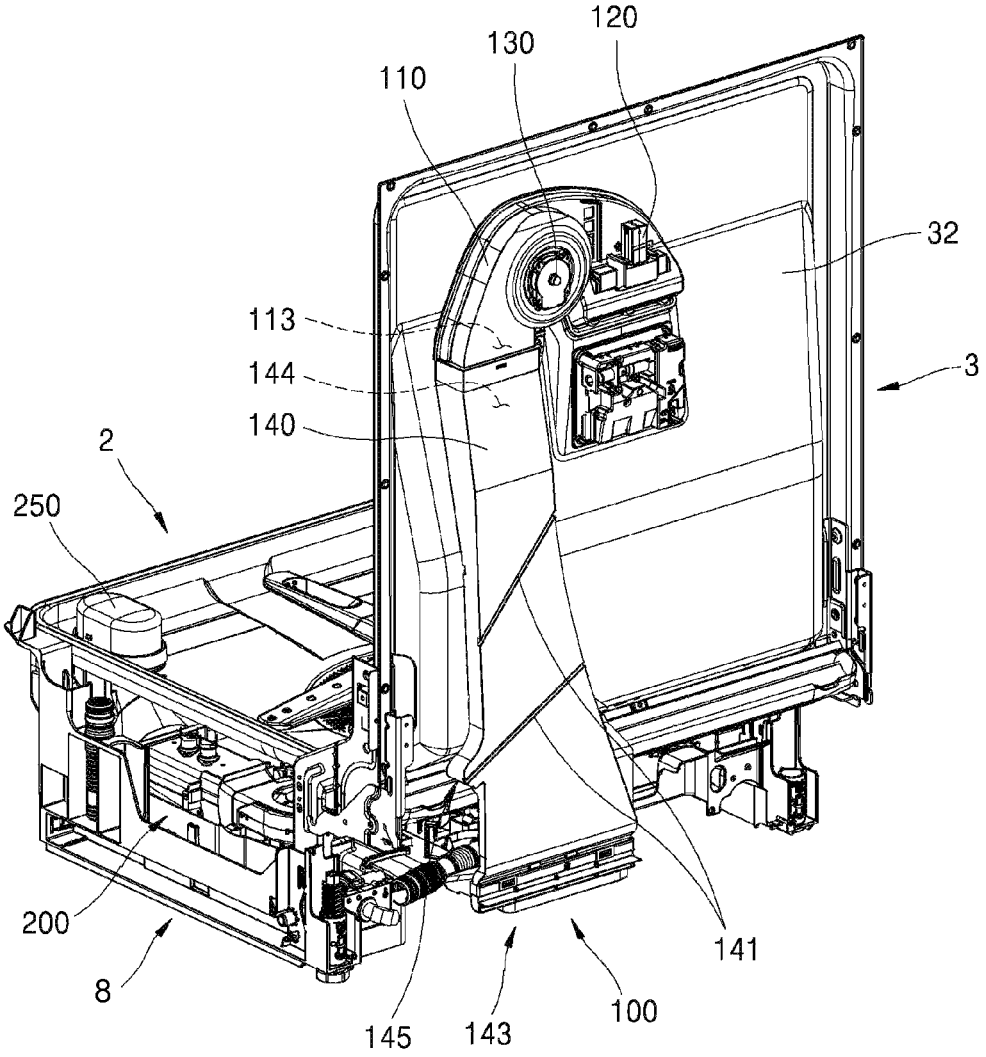
FIG. 2 is a perspective view showing an example of a tub and a base that are provided in the dishwasher.

FIG. 2 is a perspective view showing a tub 2 and a base that are provided in a dishwasher.

Figure 3A:
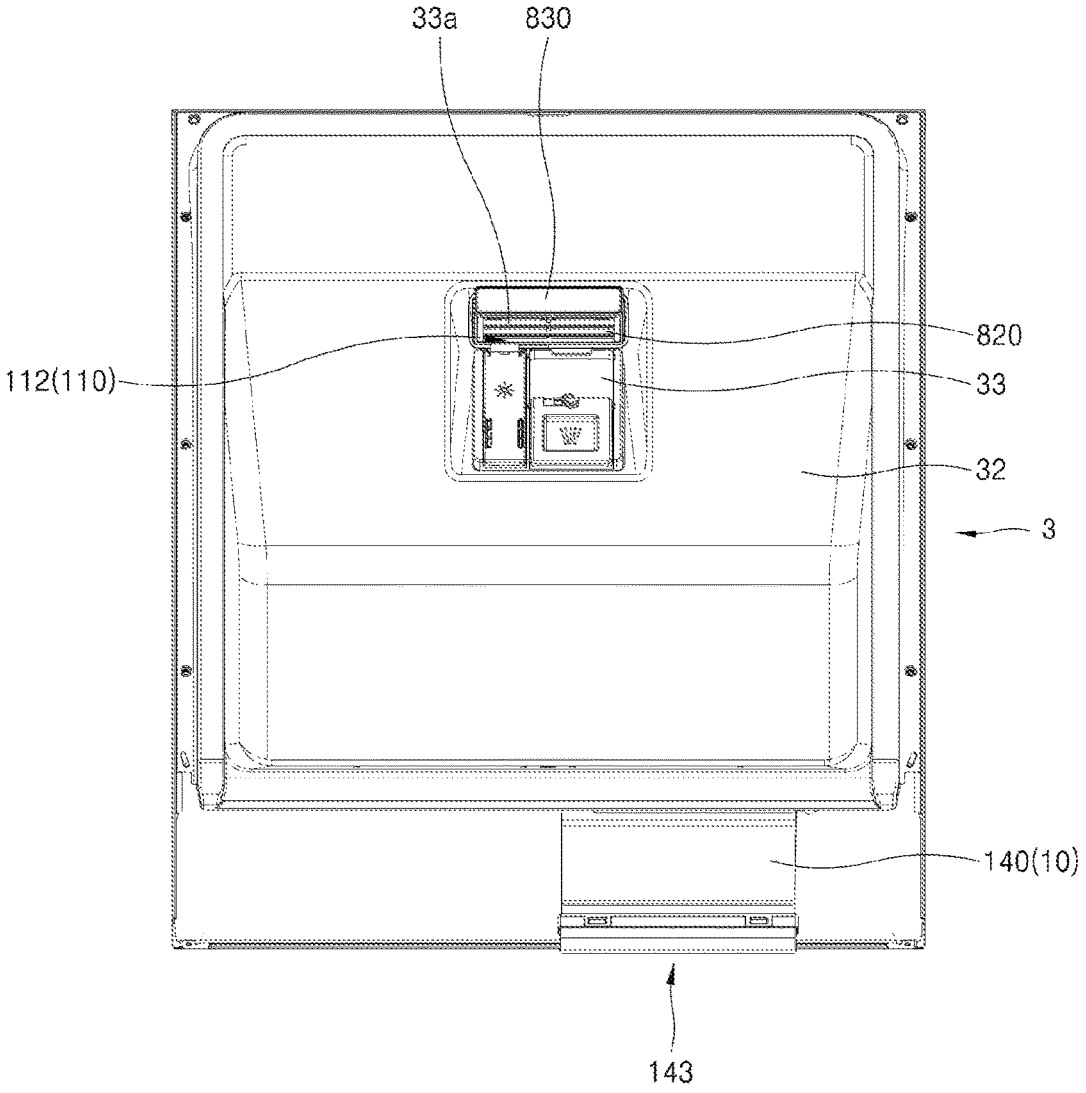
FIG. 3A is a rear view of an example of a door of the dishwasher.
Figure 3B:
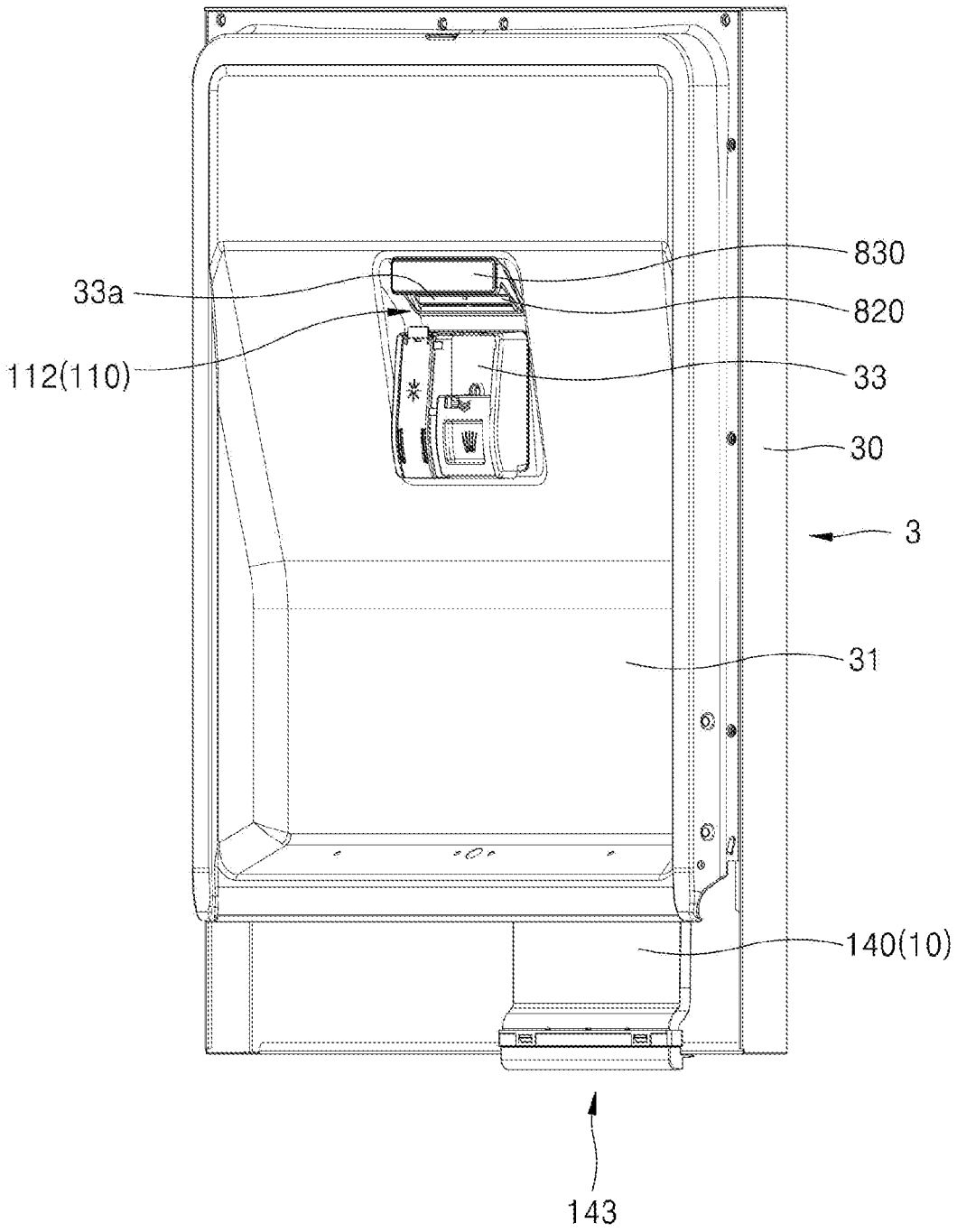
FIG. 3B is a rear perspective view showing the door.
Figure 3C:
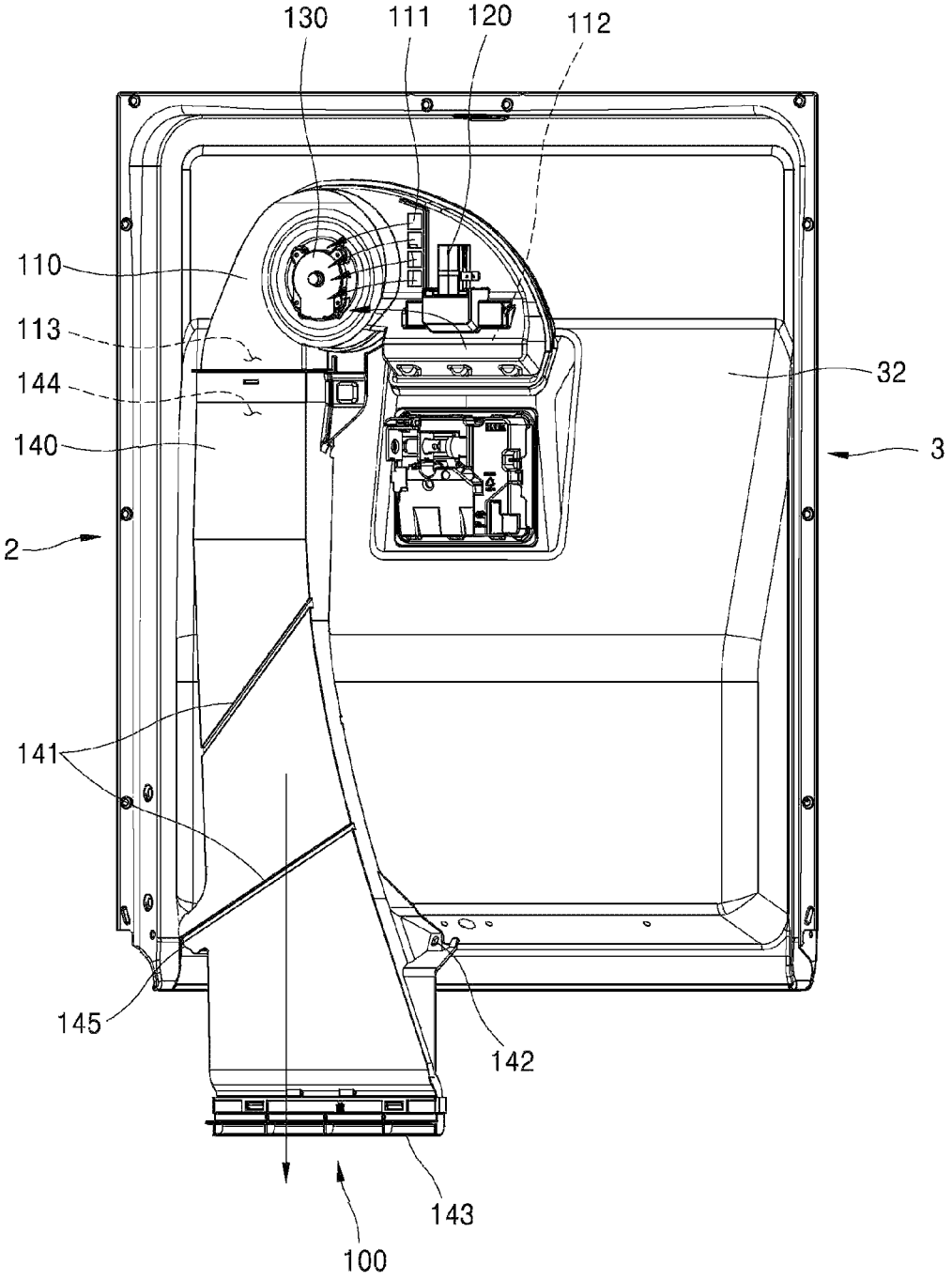
FIG. 3C shows an example of a drying device disposed on a lateral wall of a tub of the dishwasher.

FIG. 3A is a rear view of a door 3. FIG. 3B is a rear perspective view showing a door 3. FIG. 3C shows a state where a drying device is disposed on a lateral wall of a tub 2.

In some implementations, the dishwasher can include the drying device 100 and the dry air supplier 200. When a drying process configured to dry water remaining on the dishes held in the tub 2 is performed in the dishwasher, the drying device 100 and the dry air supplier 200 can be used.

The drying device 100 and the dry air supplier 200 can be put into operation after a heating and rinsing process configured rinse the dishes held in the tub 2 by heating wash water in an entire washing process. The drying device 100 can be disposed between the door 3 and the tub 2 of the dishwasher. The dry air supplier 200 can be disposed in the base supporting the lower area of the tub 2. The drying device 100 can be secured to the door 3 and configured to dry the inside of the tub 2 by discharging the wet air flowing in from the inside of the tub 2 and the dry air flowing in from the outside of the tub 2.

Hereinafter, the wet air refers to air with a high humidity that flows in the drying device 100 from the inside of the tub 2. The dry air refers to air with a low humidity around the dishwasher that flows into the drying device 100 from the outside of the tub 2. The humidity of the wet air can be higher than that of the dry air.

In the following, unless otherwise specified, humidity refers to absolute humidity and relative humidity. In addition, mixed air refers to air that is made by mixing the wet air and the dry air described above with each other in the drying device 100. The humidity of the mixed air can be lower than that of the wet air and higher than the dry air.

In the following, the dry air, the wet air and the mixed air are used in the description related to the drying device 100, and are not used in the description related to the dry air supplier 200.

The drying device can be configured to lead in wet air from the tub 2 and lead out the wet air to the outside of the tub 2. The drying device 100 can mix the wet air flowing in from the inside of the tub 2 and the dry air flowing in from the outside of the tub 2 with each other, and can discharge the mixed air to the outside of the dishwasher, to constantly lower the humidity inside the tub 2.

Accordingly, the drying device 100 can discharge steam inside the tub 2 to the outside of the tub, can vaporize the wash water remaining on surfaces of the dishes held in the tub 2, only to dry the dishes.

The drying device 100 can include a casing 110, an actuator 120, a first ventilation fan 130 and a duct 140. The casing 110 can have a first air inlet 111 configured to lead in the dry air from the outside. The casing 110 can provide a space in which the wet air and the dry air flow.

The casing 110 can further have a second air inlet 112 configured to lead in the wet air. The first air inlet 111 and the second air inlet 112 can be spaced a preset distance apart from each other. For example, the first air inlet 111 can be in communication with the outside of the drying device 100 and the dry air that is external air around the dishwasher can flow into the drying device 100 through the first air inlet 111. The second air inlet 112 can be in communication with the tub 2, and the wet air inside the tub 2 can flow in the drying device 100 through the second air inlet 112. The dry air and the wet air flowing into the drying device 100 can be mixed with each other in the drying device to be the mixed air.

The actuator 120 can be secured to the casing 110 and configured to open and close the second air inlet 112. The actuator 120 can be operable under the control of a controller provided in the dishwasher. When a drying process is in progress, the actuator 120 can operate to open the second air inlet 112 and the wet air inside the tub 2 can flow into the drying device 100 accordingly.

While the second air inlet 112 is open, the actuator 120 can operate again to close the second air inlet 112. When the actuator 120 closes the second air inlet 112, the wet air inside the tub 2 may not flow in the drying device 100 and the drying process can end.

The first ventilation fan 130 can be secured to the casing 110 and configured to mix the dry air with the wet air and force the flow of the mixed air. The first ventilation fan 130 can be rotatable under the control of the controller provided in the dishwasher.

The wet air and the dry air can be mixed to be the mixed air before they flow in the first ventilation fan 130. The mixed air can be further mixed while passing through the first ventilation fan 130, and can be introduced into the duct 140.

The wet air and the dry air can be introduced and mixed inside the casing 110 by the first ventilation fan 130. The mixed air can be discharged to the outside of the duct 140 from the casing 110 by the first ventilation fan 130, after sequentially pasting through the first ventilation fan 130 and the duct 140.

The duct 140 can be disposed to communicate with the casing 110 and can provide a passage for discharging the mixed air flowing out from the first ventilation fan 130 to the outside. The duct 140 can be disposed to communicate with an outlet of the casing 110 and can provide a passage for discharging the mixed air flowing out from the first ventilation fan 130.

An inlet of the duct 140 can be in communication with the outlet of the casing 110 and an outlet of the duct 140 can be directly connected to the outside air. Accordingly, the mixed air discharged from the outlet of the duct 140 can have a higher humidity than the surrounding air, that is, the dry air.

The door 3 can be coupled to the front of the tub 2 and configured to open and close the tub 2. The door 3 can open and close the tub based on rotation with respect to the tub 2. A handle 31 (see FIG. 5) can be secured to an outer surface of the door 3 so that the user can open and close the door 3, with holding the handle.

The door 3 can include a body 30 and a liner 32. The body 30 can be disposed in an outer area of the door 3 and the handle 31 can be secured to the body 30.

When the door 3 is closed to close the tub 2, the liner 32 can be configured to seal between the tub 2 and the body 30 of the door 3 so that the wash water inside the tub 2 may not leak to the outside of the dishwasher.

Accordingly, the liner 32 can be secured to an inner surface of the door 3 to seal between the tub 2 and the door 3. In some examples, an accommodation mechanism 33 can be provided on an inner surface of the liner 32 and a dishwashing detergent accommodated in the accommodation mechanism 33 can be introduced into the tub 2 as much as needed to be mixed with wash water.

A space 3*a* can be formed between the liner 32 of the door 3 and the body 30 and the drying device 100 can be provided inside the space 3*a*. A drying process can be performed by discharging water vapor inside the tub to the outside by operating the drying device 100 provided in the dishwasher.

The drying device 100 can be secured to the door 3 and configured to discharging the wet air flowing in from the inside of the tub 2 and the dry air flowing in from the outside of the tub 2, to as dry the inside the tub 2.

A communication hole 33*a* can be formed in the liner 32 to facilitate communication between the tub 2 and the inside of the drying device 100. The communication hole 33*a* can be formed at a position corresponding to the second air inlet 112 of the drying device 100. Accordingly, wet air inside the tub 2 can flow into the drying device 100 through the communication hole 33*a* and the second air inlet 112.

The communication hole 33*a* can be disposed in a surface of the liner 32 that faces the tub 2. The drying device 100 can include a mesh member 820 coupled to the drying device 100 at a position corresponding to the communication hole 33*a*.

The mesh member 820 can include a plurality of ribs. Accordingly, wet air can be introduced into the drying device 100 through the communication hole 33*a* but relatively large objects can be blocked from flowing into the drying device 100 by the mesh member 820.

The mesh member 820 can block a large object inside the tub 2 from flowing into the drying device 100. In addition, the mesh member 820 can suppress the user's finger from being suctioned into the drying device 100 through the communication hole 33*a* when the user touches the communication hole with the finger.

The drying device 100 can include a name plate 830. The name plate 830 can be coupled to a predetermined area of the mesh member 820. The name plate 830 can be coupled to the predetermined area of the mesh member 820 not to cover the communication hole 33*a*. The name and function of the drying device 100 can be written on the name plate 830.

The duct 140 can have a longitudinal direction disposed in a vertical direction of the dishwasher. The duct 140 can be disposed to communicate with the casing 110. In some examples, the casing 110 and the duct 140 can be fabricated as separate parts and assembled to be in communication with each other. As another example, the casing 110 and the duct 140 can be integrally formed with each other.

The casing 110 can have an air outlet 113 through which the mixed air is discharged. A third air inlet 144 can be formed in an upper area of the duct 140 to communicate with the air outlet 113 of the casing 110 and configured to introduce the mixed air into the duct 140. An air outlet 143 can be formed in a lower area of the duct 140 to discharge the mixed air to the outside of the drying device.

The duct 140 can include an inducing portion 141 and a recollecting hole 145. It is better not to generate dew due to condensation inside the duct 140. The inducing portion 141 and the recollecting hole 145 can be provided to handle when condensate is generated due to dew condensation occurring inside the duct 140.

A plurality of inducing portions 141 can be disposed on an inner wall of the duct 140 in a direction in which the mixed air flows, and configured to drop the condensate generated on the inner wall of the duct 140 to the lower area.

The recollecting hole 145 can be formed below the inducing portion 141, in communication with the tub, and configured to provide a passage along which the dropped condensate is recollected in the tub 2.

The plurality of inducing portions 141 can include a plurality of protrusions protruded toward the inside of the duct and spaced a predetermined distance apart from each other along the flowing direction of the mixed air. Such a structure can induce to generate a condensate in the inducing portion if condensation occurs in the duct 140.

The inducing portion 141 can be disposed, with a longitudinal direction that is inclined with respect to a direction in which gravity acts. Accordingly, the water condensed in the inducing portion 141 can fall along the inducing portion 141 due to gravity.

The recollecting hole 145 can be disposed at a position corresponding to a lowermost end of the inducing portion 141 so that the condensed falling along the inducing portion 141 can easily reach the recollecting hole 145. When too much condensate is generated in the duct 140, the condensate can be discharged to the outside of the duct 140 through the recollecting hole 145.

Dew condensation could occur in that water is condensed from the mixed air flowing inside the duct 140 to generate dew on the inner wall of the duct 140. While falling by gravity, the condensate generated on the inner wall can flow downward along the longitudinal direction of the inducing portion 141 protruded from the inner wall of the duct 140, and can be collected in the lower area of the duct 140.

The condensate collected in the lower area of the duct 140 can flow through the recollecting hole 145. A hose, for example, can be secured to the recollecting hole 145 and the hose can be in communication with the inside of the tub 2.

Accordingly, the condensate flowing downward along the inducing portion 141 can sequentially pass through the recollecting hole 145 and the hose, to be recollected in the tub 2. The condensate recollected inside the tub 2 can be introduced into the sump disposed below the tub 2. Due to this structure, the condensate generated on the inner wall of the duct 140 can be recollected in the tub 2.

In some examples, the duct 140 can have a coupling hole 142 formed at a position distant from the recollecting hole 145 and a coupling member such as a bolt for coupling the duct 140 to the door 3 can be coupled to the coupling hole 142.

Referring to FIG. 3C, air flow inside the drying device 100 will be described below. Air flow is shown as an arrow in FIG. 3C.

When the second air inlet 112 is opened by operating the actuator 120 to operate the first ventilation fan 130, wet air inside the tub 2 can flow into the casing 110 through the second air inlet 112. In addition, dry air can flow into the casing 110 through the first air inlet 111 formed in the lateral wall of the casing 110 by the operation of the first ventilation fan 130.

The wet air and the dry air flowing in the casing 110 can meet each other in the inner space of the casing 110 prior to the first ventilation fan 130, and can be mixed with each other to be the mixed air. The wet and dry air constituting the mixed air can be further mixed while passing through the first ventilation fan 130, to flow in the duct 140.

After passing through the duct 140, the mixed air can be discharged to the outside of the drying device 100 through the outlet of the duct 140 disposed in the lower area of the duct 140.

Figure 4:
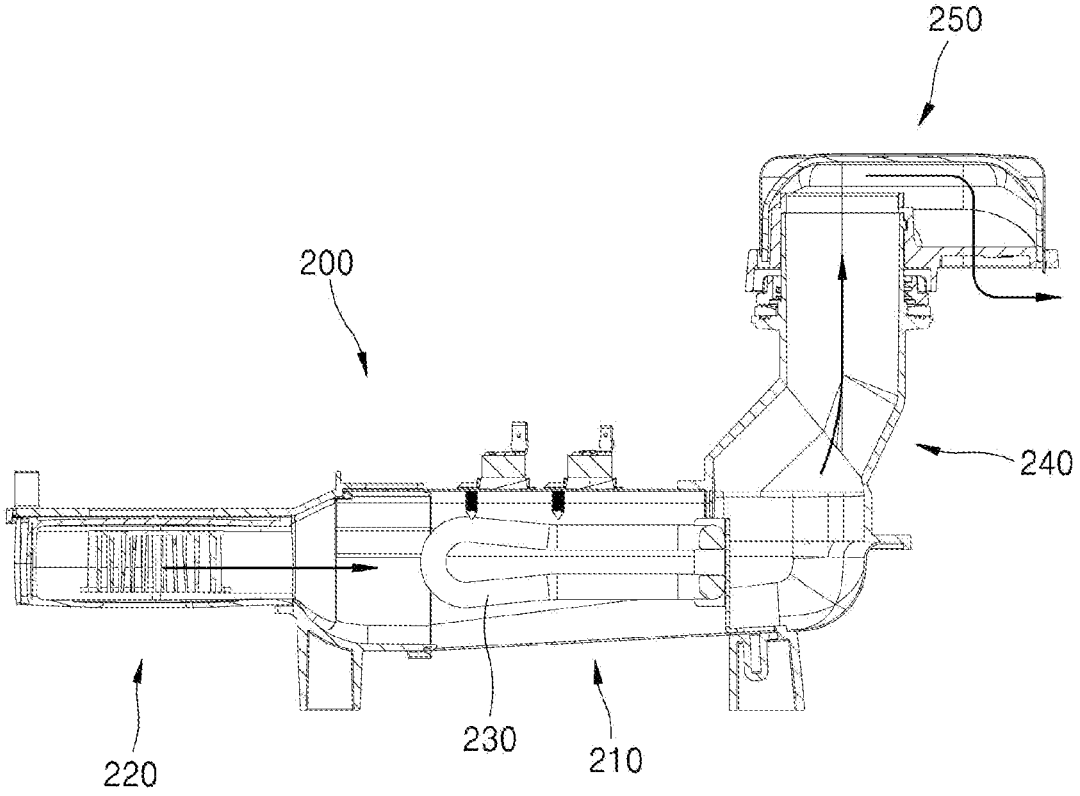
FIG. 4 is a sectional view showing an example of a dry air supplier of the dishwasher.

FIG. 4 is a sectional view of a dry air supplier 200. The dry air supplier 200 can include a heating part 230 configured to spray heated air to the tub 2.

The dry air supplier 200 can be disposed in the base and configured to communicate with the tub 2 in order to spray air to the tub 2. The dry air supplier 200 can be configured to dry the dishes stored in the tub by spraying dry air that is the heated air into the tub 2.

The dry air supplier 200 can be configured to spray cool air that is not heated air or hot air that is heated air. The dry air supplier 200 can be configured to spray cool air or hot air into the tub 2 by controlling the operation of the heating part 230 provided in the dry air supplier 200.

While not operating the heating part 230, the dry air supplier 200 can spray cool air into the tub 2. While operating the heating part 230, the dry air supplier 200 can spray the dry air that is hot air into the tub 2. In the following, unless otherwise specified, the dry air supplier 200 for spraying the dry air, which is hot air, will be described.

Referring to FIG. 4, the dry air supplier 200 can include a housing 210, a second ventilation fan 220, a heating part 230, an air discharge part 240 and a discharge cap 250.

The housing 210 can define an overall exterior of the dry air supplier 200 and a passage of air flow can be formed in the housing 210. The second ventilation fan 220 can be mounted in the housing 210 and a predetermined area of the heating part 230 can be disposed inside the housing 210.

The second ventilation fan 220 can be mounted inside the housing 210 and configured to forcibly flow the air introduced into the dry air supplier 200. The second ventilation fan 220 can be controlled by a controller provided in the dishwasher/

The second ventilation fan 220 can include a fan configured to forcibly blow air, and a bracket to which the fan is rotatably coupled, with a structure corresponding to a shape of the fan.

The second ventilation fan 220 can have an air inlet hole configured to withdraw external air. The air inlet hole can be formed to withdraw air in a direction that is parallel to a rotation axis of the fan. The air inlet hole can include a hole in the bracket of the second ventilation fan 220.

The heating part 230 can have at least some area mounted in the housing 210, and can be configured to heat the air forcibly flowing by the ventilation fan. The area of the heating part 230 exposed to the outside of the housing 210 can be for connection to a power source.

The heating part 230 can be mounted inside the housing 210 and the air forcibly flowing by the ventilation fan be heated by the heating part 230 to become dry air.

For example, the heating part 230 can be an electric resistance type heating coil (i.e., a sheath heater) but is not limited thereto. Accordingly, one end of the heating part 230 can be partially exposed to the outside of the housing 210 to be electrically connected to the power source.

The air discharge part 240 can be can be coupled to the housing 210 to be in communication with an air outlet of the housing 210 and configured to guide the flow of air discharged to the tub 2. The air discharge part 240 can have a hollow for air flow and serve as a duct accordingly.

An air discharge hole is formed at one end of the air discharge part 240 to discharge air. The air discharge hole can be configured to communicate with the inside of the tub 2. Accordingly, the air discharged through the air discharge hole can flow into the tub to be dispersed.

A through-hole can be formed on a bottom plate of the tub 2 at a position corresponding to an upper area of the air discharge part 240. An upper area of the air discharge part 240 can be inserted in the through-hole to supply dry air to the tub 2 through the air discharge part 240 from the dry air supplier 200 disposed on the base.

The discharge cap 250 can be coupled to an end of the air discharge part 240 and exposed to the tub, and configured to discharge the forcibly flowing air to the tub 2. The discharge cap 250 can be coupled to the end of the air discharge part 240 and disposed on the bottom plate of the tub 2.

Accordingly, the discharge cap 250 can be disposed to be exposed to the lower area of the tub 2. Dry air can be evenly spread in the washing space formed inside the tub 2 by the discharge cap 250.

In FIG. 4, a passage through which air flows in the dry air supplier 200 is shown by an arrow. Referring to FIG. 4, the air forcibly blown inside the dry air supplier 200 by the second ventilation fan 220 can flow in the following order.

Once the second ventilation fan 220 is put into operation, air can be introduced into the second ventilation fan 220 through the air inlet of the second ventilation fan 220.

The air after passing through the second ventilation fan 220 can be drawn into the housing 210 that is in communication with the second ventilation fan 220, and can be heated by the heating part 230 disposed in the housing 210 to be discharged from the casing 110 and flow into the air discharge part 240. The air discharged from the air outlet of the air discharge part 240 can flow into the tub 2 through the discharge cap 250, thereby supplying dry air to the tub 2.

Figure 5:
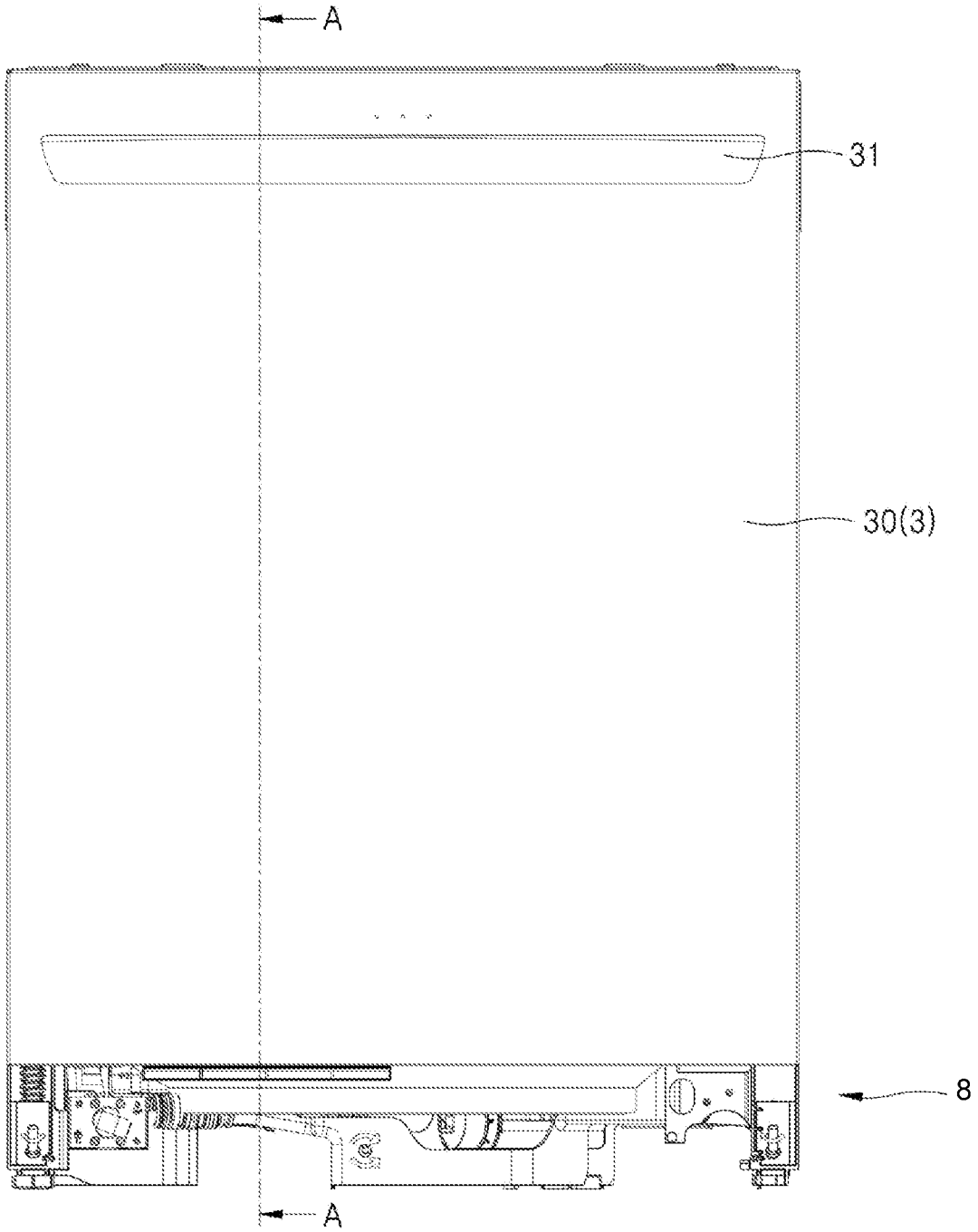
FIG. 5 is a front view of the dishwasher.
Figure 6:
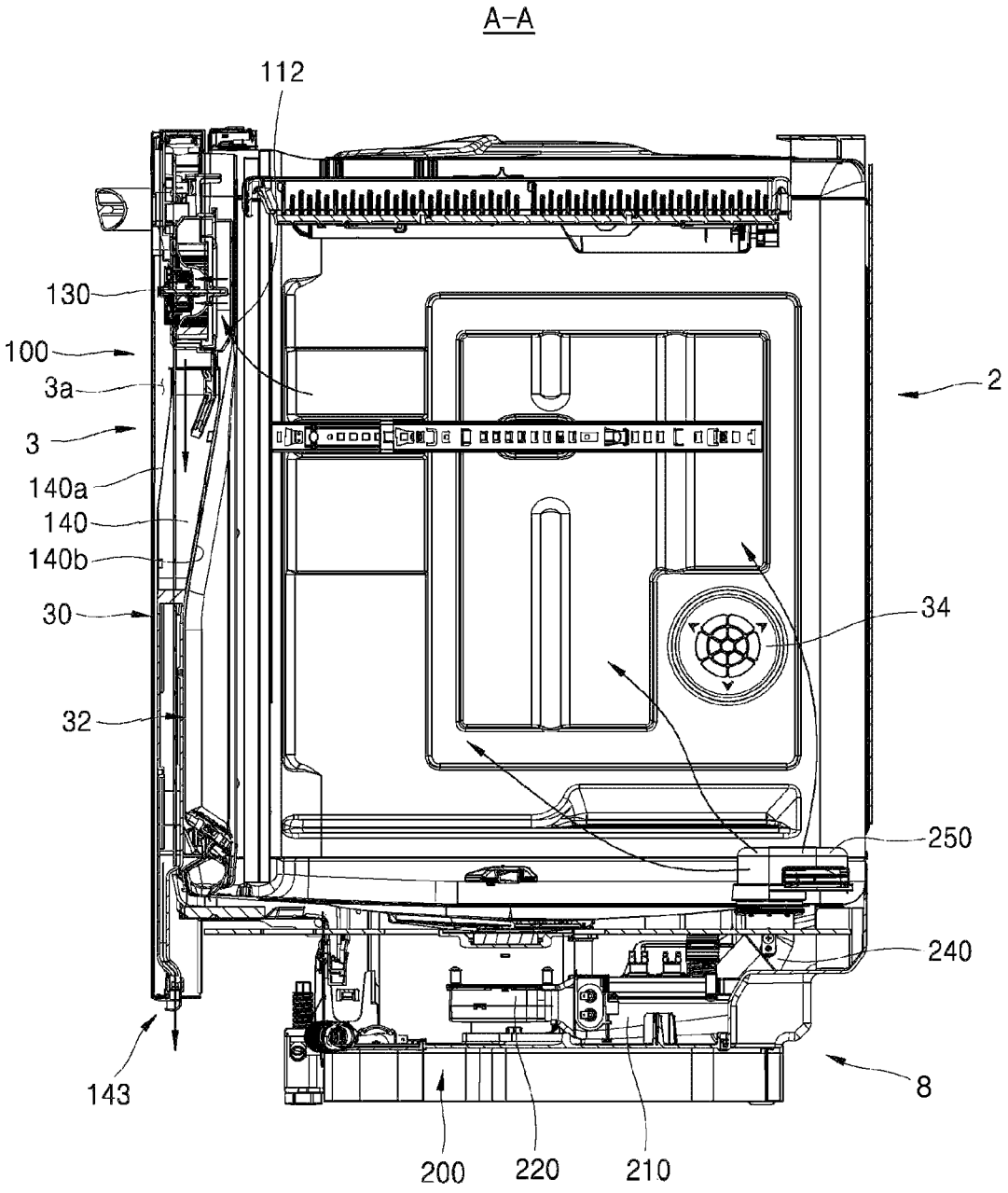
FIG. 6 is a sectional view along AA from FIG. 5.

FIG. 5 is a front view of a dishwasher. FIG. 6 is a sectional view cut away along AA from FIG. 5. In FIG. 6, the flow path of the dry air discharged from the dry air supplier 200 to the tub 2 and the flow pat of the wet air discharged from the tub 2 to the drying device 100 are shown by arrows.

The drying device 100 can be disposed in the space 3*a* formed by the door body 30 and the liner 32 that are provided in the door 3. In a heating and rinsing process, the inside of the tub 2 can be heated. Accordingly, dry air inside the space 3*a* of the door 3 can have a higher temperature than room air outside the dishwasher.

The dry air inside the space 3*a* can have a temperature gradient in which the temperature decreases from the tub to the outside of the door 3. Accordingly, an outer lateral surface 140*a* of the duct 140 that faces the outer surface of the door 3 can be in thermal equilibrium with the outside air of the dishwasher, so that the temperature of the outer lateral surface 140*a* can be similar to that of the outside air.

When the temperature of the outside air is very low, the temperature of the outer lateral surface 140*a* of the duct 140 can be also low. Accordingly, when the mixed air passes through the inside of the duct 140, excessive condensation could occur inside the duct 140.

In some implementations, to suppress excessive condensation inside the duct, a preheating operation which will be described later can be performed. In the preheating, the first ventilation fan can be operated in a state where the second air inlet is closed to flow the dry air somewhat heated in the drying device 100 in the heating and rinsing process and preheat the duct 140. After that, the temperature of the outer lateral surface 140*a* of the duct 140 that could be cooler than the inner surface 140*b* of the duct 140 can be increased to increase the temperature of the duct 140.

When the preheating is performed, the occurrence of dew condensation due to the temperature difference inside the duct 140 can be effectively suppressed.

According to a control method of a dishwasher, while the drying process is performed, the drying device 100 and the dry air supplier 200 can controlled by the controller.

The relatively dry and hot air supplied by the dry air supplier 200 can flow into the tub 2 and the dry air can be configured to effectively vaporize water remaining on the dishes stored in the tub 2.

The drying device 100 can be configured to discharge the wet air generated inside the tub to the outside of the dishwasher by performing the heating and rinsing process to lower the humidity inside the tub 2.

In some implementations, the drying device 100 and the dry air supplier 200 can be used together in the drying process, so that the dry air supplier 200 can vaporize the water remaining on the dishes quickly and the drying device 100 can discharge the wet air inside the tub 2 to the outside of the dishwasher quickly. Accordingly, the time taken to dry dishes can be significantly shortened.

According to a control method of a dishwasher, while the drying process is performed, the flow rate of the wet air discharged from the drying device 100 from the tub 2 can be controlled by the controller to be greater than or equal to that of the air flowing into the tub 2 from the dry air supplier 200.

Due to this structure, the flow rate of the air flowing into the tub 2 during the drying process can be equal to or smaller than that of the air discharged from the tub 2. Accordingly, the internal pressure of the tub 2 during the drying process can maintain a zero pressure (gauge pressure) that is equal to atmospheric pressure or a negative pressure state that is lower than atmospheric pressure.

Since the tub 2 maintains the zero pressure or negative pressure during the drying process, the flowing of the dry air into the tub from the drying device 100 can be smoothly performed.

In addition, since the tub 2 maintains the zero pressure or negative pressure during the drying process, the wet air inside the tub 2 can be suppressed from leaking through a gap of the tub 2 rather than the outlet of the duct 140.

Accordingly, dew condensation that might occur on the outer surface of the dishwasher due to the wet air leaking through the gap of the tub can be effectively suppressed. Also, injuries to the dishwasher user due to the wet air can be effectively suppressed.

Referring to FIG. 6, the discharge cap 250 can be disposed at a lower corner area of the tub 2, adjacent to one wall of the tub 2. The actuator 120 can be an upper area of the other wall opposite to the wall of the tub.

In some examples, the second air inlet 112 of the drying device 100 can be disposed at the same position as the actuator 120. Accordingly, the actuator and the second air inlet 112 can be positioned at the same position in the tub 2.

Specifically, the outlet of the discharge cap 250 for flowing dry air from the tub and the second air inlet 112 formed in the drying device 100 to flow wet air can be disposed in a diagonal direction to each other, viewed from the cross section of the tub.

The outlet of the discharge cap 250 can have a structure configured to uniformly diffuse the dry air into the tub 2. Accordingly, the discharge cap 250 can be disposed at the position described above and the dry air discharged from the discharge cap 250 can be uniformly diffused in the tub 2.

Since the second air inlet 112 is disposed in a diagonal direction with respect to the discharge cap 250 from the discharge cap 250 in the tub, the discharge cap 250 and the second air inlet 112 can be spaced apart from each other. That is, there can be considerable distance for the dry air discharged from the discharge cap 250 to flow into the second air inlet 112.

Due to this structure, the dry air discharged from the discharge cap 250 may not be introduced into the drying device 100 through the second air inlet 112 but sufficiently diffused in the washing space of the tub 2 enough to vaporize the water remaining on the dishes stored in the tub 2.

After serving the function of vaporizing the water, the dry air drawn into the tub 2 can be mixed with water vapor existing in the tub 2 to become wet air, and the wet air can be introduced into the drying device 100 through the second air inlet 112.

In some implementations, a straight line connecting the discharge cap 250 and the second air inlet 112 can be arranged to form a diagonal line of the tub 2, viewed from a cross-section of the tub 2. Accordingly, the outlet of the discharge cap 250 and the second air inlet 112 can be spaced apart from each other. The dry air discharged from the discharge cap 250 can be sufficiently diffused in the tub, without flowing in the second air inlet 112, to effectively vaporize the water remaining on the dishes stored in the tub 2.

During the drying process, air flow inside the tub 2 can be performed as follows. In the drying process, the dry air supplier 200 and the drying device 100 can be operable together.

The air introduced into the dry air supplier 200 can be heated while passing through the heating part 230. The heated air can pass through the discharge cap 250 and can be introduced into the tub 2. The dry air discharged from the discharge cap 250 can be uniformly diffused to the entire tub 2 and evaporate the water remaining on the dishes.

The wet air of the tub 2 can be heated by the heated air flowing in the tub 2 can be heated by the heated air, that is, the dry air to flow into the drying device 100. The dry air can be mixed with water vapor present in the tub 2 to become wet air.

The wet air and dry air flowing in from the outside can be mixed with each other in the drying device 100 to form the mixed air. The mixed air can pass through the duct 140 to be discharged to the outside.

The mixed air can have a lower humidity than the wet air and higher humidity than the dry air. As the mixed air is continuously discharged to the outside, the amount of water vapor inside the tub 2 can be continuously lowered.

The water remaining on the dishes stored in the tub can be continuously evaporated by the dry air supplier 200 to become water vapor and the water vapor can be continuously discharged to the outside by the drying device 100. When this drying process is performed, the water inside the tub 2 can be discharged to the outside and the drying of the dishes can be completed.

The wet air flowing into the drying device 100 from the tub 2 can be relatively high-temperature and the dry air flowing into the drying device 100 from the outside can be relatively low-temperature.

When the high-temperature wet air and the low-temperature dry air are mixed with each other, condensation could occur in the wash water existing in a vapor state in the high-temperature wet air and dew condensation could occur in which condensate (i.e., condensed water) is generated by condensation. The condensate might be condensed on the inner wall of the drying device 100 and might fall by gravity.

The condensate falling by gravity could accumulate on the floor of the location where the dishwasher is disposed through the outlet for the mixed air. The user inconveniently wipes out and cleans the accumulating condensate.

In particular, dew condensation might occur in the duct 140 provided to discharge the mixed air generated in the drying device 100.

The outer surfaces of the duct 140 can be exposed to ambient air with a low temperature, and the mixed air with a relatively high humidity and high temperature can flow in the duct 140.

Due to the temperature difference between the ambient air and the mixed air in the duct 140, the mixed air can be partially cooled on the inner wall of the duct 140. Accordingly, some portion of the mixed air with high humidity could be condensed and dew might occur on the inner wall of the duct 140, which is a dew condensation.

The condensate generated from the mixed air could be condensed on the inner wall of the duct 140 and fall by gravity to leak to the bottom of the position where the dishwasher is arranged through the outlet formed in the lower area of the duct 140.

Accordingly, there is a need for a structure configured to suppress the occurrence of dew condensation in the duct 140 during the drying process of the dishwasher in which the drying device 100 operates.

A control method of the dishwasher can include a preheating process configured to preheat the duct 140 before the drying process to suppress dew condensation inside the duct 140.

The drying device 100 can preheat the drying device 100 by forcibly flowing the dry air introduced from the outside before a preset time period from a start point of the drying process at which the wet air starts to flow in from the tub 2. The preset time period from the start point of the drying process, that is, the preheating time can be approximately 5 minutes, for example.

The preheating process can be performed by operating only some components of the drying device. In the preheating process, the operation of the dry air supplier 200 can be stopped and the second air inlet 112 of the drying device 100 can be closed, and only the first ventilation fan 130 can operate to flow the dry air in the drying device 100.

The drying device 100 can be secured to the door 3, adjacent to the tub 2. Since the heating and rinsing process configured to rinse the dishes by using heated water (i.e., warm water) is performed before the preheating process, dry air around the dishwasher is heated to some extent by the warm water.

When the heated dry air flows inside the drying device 100, the duct 140 provided in the drying device 100 can be preheated. When the duct 140 is heated to be in sufficiently heated state, the temperature difference between the duct 140 and the mixed air flowing inside the duct 140 can be reduced.

Accordingly, the reduced temperature difference between the duct 140 and the mixed air can effectively suppress dew condensation occurring on the inner wall of the duct 140 due to the large temperature difference.

The dry air supplier 200 can have the built-in heating part 230 and the heating part 230 can become high-temperature in the process of generating the dry air so that the dry air supplier 200 as a hole can become high temperature. At least some area of the dry air supplier 200 can be exposed to the tub 2. In some cases, the user might inadvertently bring his/her body part into contact with the dry air supplier 200, which might result in injury to the user. In particular, the discharge cap 250 exposed to the tub 2 can be heated to a high temperature and the user could easily touch the discharge cap 250. In some cases, the user might be burned.

Accordingly, a control method of the dishwasher can include a cooling process configured to cool the discharge cap 250 provided in the dry air supplier 200. Specifically, the cooling process for cooling the dry air supplier 200 including the discharge cap 250 can be performed before the drying process is completed.

The dry air supplier 200 can cool the dry air supplier 200 by stopping the operation of the heating part 230 before a preset time from the end point of the drying process, that is, the cooling time can be approximately 5 minutes, for example.

The cooling process can be performed by operating only some components of the dry air supplier 200. In a state where the operation of the heating part 230 is stopped in the cooling process, the second ventilation fan 220 can be operated to flow air in the dry air supplier 200.

Since the external air in a not-heated state can flow inside the dry air supplier 200 in the cooling process, the heating part 230 and the discharge cap 250 can be cooled by the flowing external air.

While the cooling process is performed, cold air could flow in the discharge cap 250 exposed to the tub 2 by the outside air. The discharge cap 250 can be cooled by the cold air sufficiently enough to prevent the user touching it from being burned and injured.

The cooling process can end after the discharge cap 250 is sufficiently cooled, and the entire washing process can end together with the end of the cooling process.

Even if the user opens the door and touches the discharge cap 250 exposed to the tub 2 after the washing process is completed, the discharge cap 250 can be already cooled enough not to burn the user. Accordingly, it is possible to suppress the user's getting a burn.

Figure 7:
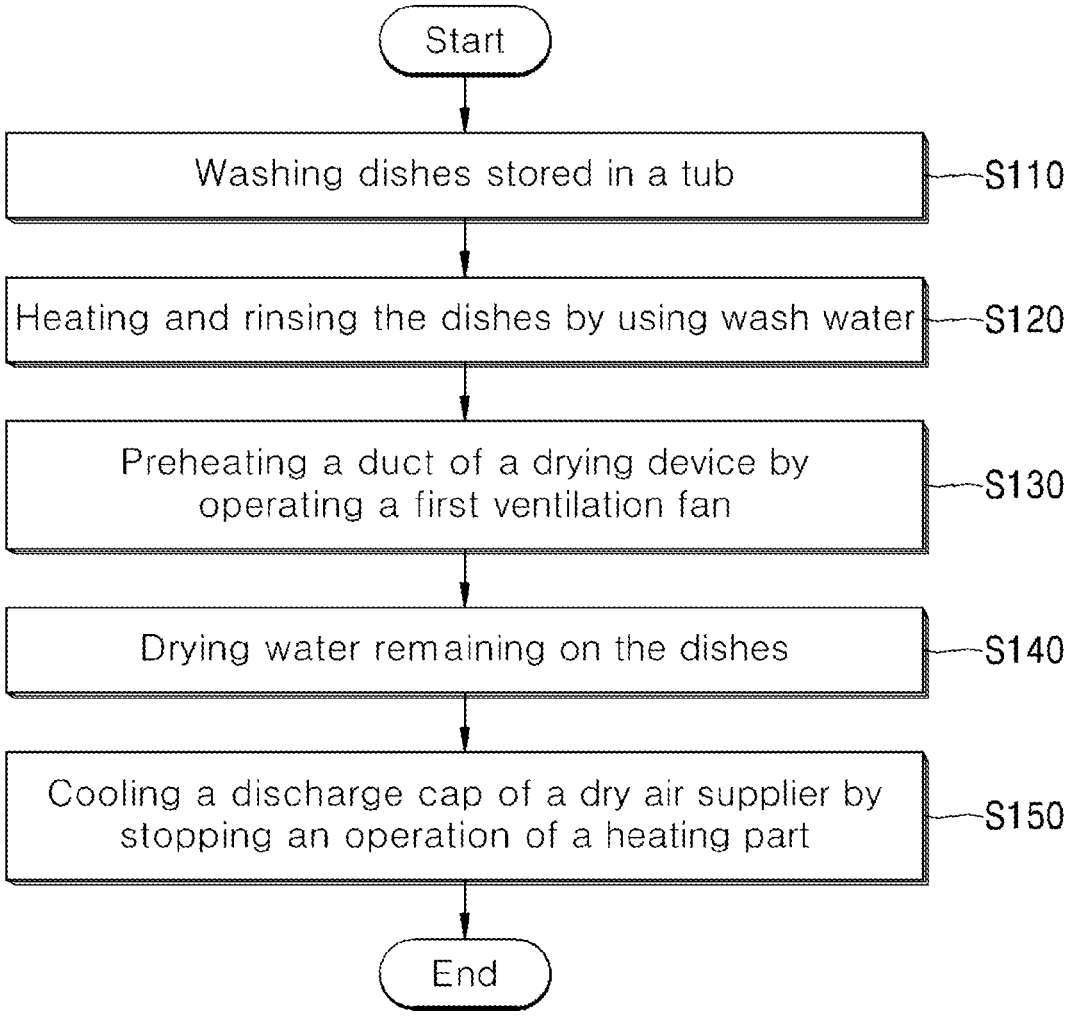
FIG. 7 is a flow chart showing an example of a method for controlling a dishwasher.
Figure 8:
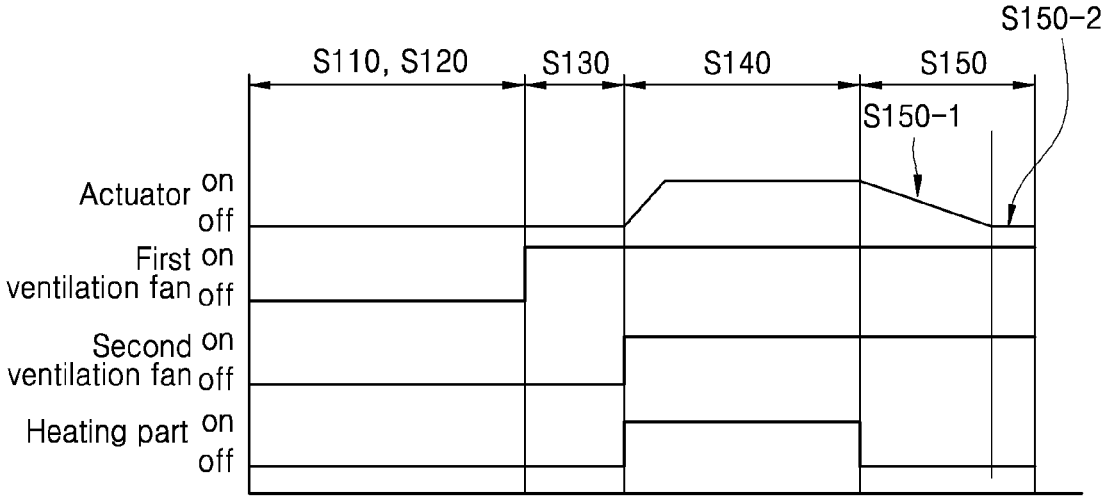
FIG. 8 is a chart showing example states of components of a drying device and a dry air supplier operate in each step of the method.

FIG. 7 is a flow chart showing a control method of a dishwasher. FIG. 8 is a chart showing whether components that are provided in a drying device 100 and a dry air supplier 200 operate in each step constituting a control method of a dishwasher. In FIG. 8, a case in which each component operates is indicated as ON and a case in which it does not operate is indicated as OFF.

The progress of each operation listed as the control method of the dishwasher can be implemented by the controller provided in the dishwasher controlling the operation of each component provided in the dishwasher.

The control method of the dishwasher can include washing S110, heating and rinsing S120, preheating S130, drying S140 and cooling S150.

In the washing, the dishes stored in the tub 2 can be washed (S110). Foreign substances remaining on the dishes can be washed off by the wash water sprayed to the dishes stored in the tub through the spray arms 6, 7, and 9.

After the washing process is completed, the dishes can be heated and rinsed by wash water (S120). The wash water can be heated using a heating device provided separately from the heating part 230 to make hot water, and the hot water can be sprayed to the dishes to rinse them through the spray arms 6, 7, and 9.

Hence, the first ventilation fan 130 can be put into operation to preheat the duct 140 of the drying device 100 (S130). The time taken to perform the preheating can be approximately 5 minutes, for example.

The actuator 120 may not immediately open or close the second air inlet 112 in operation. Since the actuator 120 can operate gradually due to its characteristics, it could take some time until the second air inlet 112 is completely closed or completely opened from the viewpoint of the second air inlet 112.

Accordingly, the inclined straight lines in FIG. 8 indicate an opening area of the second air inlet 112 varies from the closing to opening or vice versa.

In some examples, the second air inlet 112 can pass wet air even if only some area is opened. The second air inlet 112 may be completely closed to block the wet air from passing there through the second air inlet 112. Accordingly, the time taken to change the second air inlet 112 from the closed state to the open state by the operation of the actuator 120 can be shorter than the time taken to change the second air inlet 112 from the opening state to closed state.

For example, FIG. 8 shows that the time taken to open the second air inlet 112 from the closed state by the actuator 120 is relatively short, and that the time taken to close the second air inlet 112 from the open state by the actuator is relatively long.

While preheating the duct 140, the actuator 120 can be controlled to close the second air inlet 112 and the second ventilation fan 220 and the heating part 230 can be controlled to stop the operation.

In the preheating operation, the wet air may not be introduced into the drying device 100, and only the dry air inside the door 3 can flow inside the drying device 100. The dry air existing inside the door 3 is sufficiently heated while passing through the heating and rinsing operation.

Once the first ventilation fan 130 is put into operation, the heated dry air can inside the drying device 100 and then preheat the duct 140 provided in the drying device 100. When the mixed air flow inside the duct 140 in a drying operation after that, the duct 140 can be already sufficiently heated enough to reduce a temperature difference between the duct 140 and the mixed air.

Accordingly, occurrence of dew condensation can be effectively suppressed which might be caused by the water condensed on the inner wall of the duct 140 due to a large temperature difference between the duct 140 and the mixed air.

Next, the water remaining on the dishes can be dried (S140). In the drying operation, the dry air supplier 200 can operate together with the drying device 100.

While drying the water remaining the dishes, the actuator 120 can be controlled to open the second air inlet 112 and to operate the second ventilation fan 220 and the heating part 230.

In the drying operation, the dry air supplier 200 can be configured to evaporate the water remaining on the dishes stored in the tub 2 by supplying dry air to the tub 2. In addition, the drying device 100 can discharge wet air floating in the tub 2 to the outside of the dishwasher.

The drying time taken to perform the drying operation can be relatively long, compared to the cooling time taken to perform the preheating time or the cooling time taken to perform the cooling operation. The drying time can be variable based on the type and version of the dishwasher, the number of the dishes stored in the tub 2 and the like, for example, approximately 30 minutes, 55 minutes or 85 minutes.

Hence, the discharge cap 250 of the dry air supplier 200 can be cooled by stopping the operation of the heating part 230 (S150). The cooling time taken to perform the cooling operation can be approximately 5 minutes, for example.

While cooling the discharge cap 250, the operation of the heating part 230 can be stopped, the second ventilation fan 220 and the heating part 230 can operate, and the actuator 120 can operate to switch the second air inlet 112 from the open state to the closed state.

In the cooling step, the operation of the heating part 230 can be stopped and the operation of the second ventilation fan 220 can start to flow air inside the dry air supplier 200. The outside air in a not-heated state can flow inside the dry air supplier 200 in the cooling operation, so that the heating part 230 and the discharge cap 250 can be cooled by the flowing outside air.

During the cooling operation, the discharge cap 250 exposed to the tub 2 can be provided with cool air by the outside air, and can be sufficiently cooled enough not to cause the user's getting burned even if touched.

During the cooling operation, the actuator 120 can complete the closing of the second air inlet 112 before a preset time from the end point of cooling the discharge cap 250. The preset time from the end point of cooling the discharge cap 250, that is, the operation end time of the actuator 120 can be approximately 2 minutes, for example.

Accordingly, simultaneously with the start of the cooling operation, the actuator 120 can start to operate. After about 3 minutes have elapsed, the actuator 120 can complete the closing of the second air inlet 112 and stops the operation.

As described above, the actuator 120 may not open and close the second air inlet 112 immediately after starting to operate. Accordingly, the actuator 120 may not close the second air inlet immediately after the operation, and it can take a certain amount of time for the actuator 120 to close the second air inlet 112 to block the wet air of the tub 2 from flowing into the drying device 100.

In the cooling, only dry air can flow into the duct 140 during the period from the time when the closing of the second air inlet 112 is completed to the end of the cooling operation, for example, for about 2 minutes. Accordingly, the condensate or wet air that could remain in the duct 140 can be effectively removed by the dry air.

The end point of the cooling operation can be the end point of the entire process performed in the dishwasher. Accordingly, in order to complete the overall operation of the dishwasher by terminating the cooling operation, the actuator 120, which is relatively slow in operation, can be operated simultaneously with the start of the cooling operation.

Due to this, the actuator 120 can complete the closing of the second air inlet 112 and end the operation, before the end point of the cooling operation. Accordingly, it can be possible to prevent the delay of the end point of the entire dishwashing due to the operation time of the actuator 120.

Table 1 shows whether each component of the drying device 100 and the dry air supplier 200 operates in each process constituting the control method of the dishwasher. In Table 1, a case in which each component operates is indicated as ON and a case in which it does not operate is indicated as OFF.

TABLE 1

| Component | Washing & heating and rinsing operation S110, S120 | Preliminary heating S130 | Drying S140 | Cooling S150 |
|---|---|---|---|---|
| Actuator 120 | Off | Off | On | On |
| First ventilation fan 130 | Off | On | On | On |
| Second ventilation fan 220 | Off | Off | On | On |
| Heating part 230 | Off | Off | On | Off |

In the washing operation and the heating and rinsing operation, the actuator 120 and the first ventilation fan 130 of the drying device 100 and the second ventilation fan 220 and the heating part 230 of the dry air supplier 200 may not operate.

In the preliminary heating operation, the first ventilation fan 130 can operate and the heated dry air into the duct 140 can flow to preheat the duct. As described above, the dew condensation during the drying operation can be suppressed by preheating the duct 140.

In the drying operation, the actuator 120, all of the first ventilation fan 130, the second ventilation fan 220, and the heating part 230 can operate. In the drying operation, the actuator 120 can operate to open the closed second air inlet 112. Accordingly, in the drying operation, the dry air supplier 200 can supply the dry air to the tub 2 and the drying device 100 can discharge the wet air inside the tub to the outside.

In the cooling operation, the operation of the heating part 230 can stop but the first ventilation fan 130 and the second ventilation fan 220 can continuously operate. In the cooling operation, the actuator 120 can operate immediately at the start point of the cooling operation, to close the second air inlet 112, and can stop the operation before the end point of the cooling operation.

In some implementations, when the end point of the cooling operation has elapsed, the operations of the first ventilation fan 130 and the second ventilation fan 220 can stop.

Referring to FIG. 8, the cooling operation (S150) can be divided into a S150-2 section in which the actuator 120 closes the second air inlet 112 by operating gradually and a S150-2 section that is a section until the end point of the first and second ventilation fans 130 and 220 after the second air inlet 112 is completely closed.

In the S150-1 section, the second ventilation fan 220 can still operate even after an OFF command is transmitted to the actuator 120. In some examples, the heating part 230 is just after stopping the operation and residual heat remain inside the tub 2.

However, since the second air inlet is not completely closed, the air inside the tub 2 can be discharged to the outside through the drying device 100 until the second air inlet 112 is completely closed. The not-heated outside air can be introduced into the tub 2 by the second ventilation fan 220 to remove residual heat inside the tub and the air inside the tub 2 can be cooled to lower the air pressure, thereby preventing the formation of high pressure inside the tub 2.

In the S150-2 section, the first ventilation fan 130 can be operated by the actuator 120 in a state where the second air inlet 112 is completely closed. In some examples, only the outside air can be circulated in the drying device 100 and the state of the air inside the duct 140 can be balanced with the space 3*a* or the outside air.

In the S150-2 section, the inside of the tub 2 can be provided with the dry air, while the second air inlet 112 is closed. However, the duration time of the S150-2 can be shorter than that of the S150-1 and relatively low-temperature air can be supplied to the tub 2 in the S150-2 section. In addition, the air pressure inside the tub 2 can be balanced with the outside by the through-hole 34 (see FIG. 6) formed in the inner wall of the tub 2 to pass air there through, in communication with the outside of the tub 2. Due to this structure, high pressure may not be formed inside the tub 2 in the S150-2 section.

The implementations are described above with reference to a number of illustrative implementations thereof. However, the present disclosure is not intended to limit the implementations and drawings set forth herein, and numerous other modifications and implementations can be devised by one skilled in the art. Further, the effects and predictable effects based on the configurations in the disclosure are to be included within the range of the disclosure though not explicitly described in the description of the implementations.

What is claimed is:

1. A method for controlling a dishwasher, the dishwasher including a tub configured to receive objects to be washed, a drying device configured to receive wet air from the tub and to discharge the wet air to an outside of the dishwasher, and a dry air supplier including a heating part and being configured to supply heated air to the tub, the method comprising:

preheating the drying device by introducing ambient air from the outside to the drying device before a first preset time from a start point of a drying operation;

performing the drying operation at the start point, wherein wet air is discharged from the tub during the drying operation; and cooling the dry air supplier by stopping operation of the heating part before a second preset time from an end time point of the drying operation.

2. The method of claim 1, wherein the drying device includes:

a casing that defines (i) a first air inlet configured to receive the ambient air from the outside and (ii) a second air inlet configured to receive the wet air from the tub;

an actuator coupled to the casing and configured to open and close the second air inlet;

a first ventilation fan coupled to the casing and configured to cause the ambient air and the wet air to be mixed and discharged from the first ventilation fan; and a duct that is in fluid communication with the casing and configured to discharge the mixed air from the first ventilation fan to the outside, and wherein preheating the drying device comprises operating the first ventilation fan.

3. The method of claim 2, wherein the dry air supplier includes:

a housing that defines an air flow path configured to guide air discharged to the tub;

a second ventilation fan coupled to the housing and configured to cause flow of the air in the air flow path, wherein a least a portion of the heating part is disposed inside the housing to thereby heat the air blown by the second ventilation fan;

an air discharge part that is coupled to the housing and configured to guide the air from the air flow path of the housing to the tub; and a discharge cap coupled to an end of the air discharge part and exposed to the tub, the discharge cap configured to discharge the air from the discharge part to the tub.

4. The method of claim 3, wherein the drying operation comprises operating the drying device and the dry air supplier together.

5. The method of claim 4, wherein the drying operation further comprises:

heating air blown into the dry air supplier such that the air is heated through the heating part, passes through the discharge cap, and then is discharged into the tub;

heating wet air in the tub by the heated air discharged into the tub; and discharging the heated wet air from the tub into the drying device such that the heated wet air and the ambient air from the outside are mixed in the duct and discharged through the duct.

6. The method of claim 4, wherein the drying operation further comprises:

controlling a flow rate of the wet air discharged from the tub to the drying device to be greater than or equal to a flow rate of the air introduced into the tub from the dry air supplier.

7. The method of claim 3, wherein the discharge cap is disposed at a corner of a lower area of the tub adjacent to a first wall of the tub, and wherein the actuator is disposed at an upper area of a second wall facing the first wall of the tub.

8. The method of claim 3, further comprising:

washing objects in the tub; and heating and rinsing the objects in the tub by wash water, wherein preheating the drying device comprises preheating the duct of the drying device by operating the first ventilation fan after heating and rinsing the objects in the tub, wherein the drying operation is performed for drying water remaining on the objects in the tub, and wherein cooling the dry air supplier comprises cooling the discharge cap by stopping operation of the heating part.

9. The method of claim 8, wherein preheating the duct comprises:

while the duct is preheated, controlling the actuator to close the second air inlet and stopping operation of the second ventilation fan and the heating part.

10. The method of claim 4, wherein the drying operation comprises:

while water remaining on objects in the tub is dried, controlling the actuator to open the second air inlet and operating the second ventilation fan and the heating part.

11. The method of claim 8, wherein cooling the discharge cap comprises:

while the discharge cap is cooled, stopping operation of the heating part, operating the second ventilation fan and the heating part, and controlling the actuator to switch the second air inlet from an open state to a closed state.

12. The method of claim 11, wherein controlling the actuator comprises controlling the actuator to complete closing of the second air inlet before a preset time period from an end time point of cooling the discharge cap.

13. The method of claim 4, wherein the discharge cap and the second air inlet are disposed on a diagonal line across the tub in a cross sectional view of the tub.

14. The method of claim 1, wherein the first preset time is equal to the second preset time.

15. A method for controlling a dishwasher, the dishwasher including a tub configured to receive objects to be washed, a drying device including a duct and a first ventilation fan, and a dry air supplier including a heating part and a discharge cap, the method comprising:

washing objects in the tub;

heating and rinsing the objects in the tub by wash water;

preheating the duct by operating the first ventilation fan;

performing a drying operation for drying water remaining on the objects in the tub; and cooling the discharge cap by stopping operation of the heating part, wherein preheating the duct comprises:

blowing ambient air from an outside of the dishwasher to the duct before a first preset time from a start point of the drying operation, wherein wet air is discharged from the tub during the drying operation.

16. The method of claim 15, wherein cooling the discharge cap comprises stopping operation of the heating part before a second preset time from an end time point of the drying operation.

17. The method of claim 16, wherein preheating the duct comprises blocking inflow of the wet air from the tub to the duct while the duct is preheated by ambient air that is present near the dishwasher and heated while heating and rinsing the objects in the tub.

18. The method of claim 16, wherein the first preset time is equal to the second preset time.

19. The method of claim 15, wherein the drying device further includes:

a casing that defines (i) a first air inlet configured to receive the ambient air from the outside and (ii) a second air inlet configured to receive the wet air from the tub; and an actuator coupled to the casing and configured to open and close the second air inlet, wherein the first ventilation fan is coupled to the casing and configured to cause the ambient air and the wet air to be mixed and discharged from the first ventilation fan, wherein the dry air supplier further includes:

a housing that defines an air flow path configured to guide air discharged from the tub, and a second ventilation fan coupled to the housing and configured to cause flow of the air in the air flow path, wherein a least a portion of the heating part is disposed inside the housing to thereby heat the air blown by the second ventilation fan, and wherein preheating the duct comprises controlling the actuator to close the second air inlet and operating the first ventilation fan while operations of the second ventilation fan and the heating part are stopped.

20. The method of claim 19, wherein the heating part comprises a heating coil electrically connected to a power source, and wherein performing the drying operation comprises supplying electric current to the heating coil while operating the actuator, the first ventilation fan, and the second ventilation fan.

* * * * *